United States Patent [19]

Matsuo

[11] 4,372,134

[45] Feb. 8, 1983

[54] WASHING MACHINE

[75] Inventor: Katsuharu Matsuo, Aichi, Japan

[73] Assignee: Tokyo Shibaura Denki Kabushiki Kaisha, Kawasaki, Japan

[21] Appl. No.: 229,850

[22] Filed: Jan. 30, 1981

[30] Foreign Application Priority Data

Feb. 1, 1980 [JP] Japan ..... 55-11698
Feb. 4, 1980 [JP] Japan ..... 55-12232
Feb. 5, 1980 [JP] Japan ..... 55-13247[U]
Feb. 6, 1980 [JP] Japan ..... 55-13632[U]

[51] Int. Cl.[3] ..... D06F 33/02
[52] U.S. Cl. ..... 68/12 R
[58] Field of Search ..... 68/12 R; 134/57 D, 113

[56] References Cited

U.S. PATENT DOCUMENTS 3,114,253 12/1963 Morey et al. ..... 68/12 R
3,613,405 10/1971 Shimokusu et al. ..... 68/12 R
4,222,250 9/1980 Torita ..... 68/12 R

FOREIGN PATENT DOCUMENTS 2854148 6/1979 Fed. Rep. of Germany ..... 68/12 R
54-110594 2/1979 Japan .

*Primary Examiner*—Philip R. Coe
*Attorney, Agent, or Firm*—Cushman, Darby & Cushman

[57] ABSTRACT

A water receiving tub of a washing machine is provided with a washing liquid transparency detector disposed in it at its bottom, and washing and rinsing operations are controlled according to the output signal from the detector. In the washing operation, the output signal of the detector is compared with a reference signal during pause periods of a pulsator, i.e., when air bubbles formed by a detergent float up, and in the rinsing operation the comparison is made during rotation periods of the pulsator, i.e., when air bubbles are brought to the bottom of the water receiving tub by the stream of the washing liquid.

6 Claims, 27 Drawing Figures

WASHING MACHINE

This invention relates to washing machines and, more particularly, to a washing machine which can make optimum control of washing and rinsing operations.

In the usual washing machine, the washing and rinsing operations are controlled by detecting the degree of turbidity of the washing liquid. To this end, it has been in practice to provide a light emitting element and light receiving element within a washing tub such that light emitted from the light emitting element is coupled to the light receiving element through the washing liquid. The degree of turbidity of the washing liquid is detected by the average value of the received light dose, and the period of the washing and rinsing operations and the strength of the washing liquid stream in these operations are controlled according to the detected turbidity of the washing liquid. However, the washing liquid contains air bubbles formed by a detergent. When such air bubbles are found in the light path between the light emitting and receiving elements, the emitted light is scattered by these air bubbles, so that the dose of light incident on the light receiving element is reduced very much. In an extreme case, it is impossible to detect the actual turbidity of the washing liquid.

An object of the invention is to provide a washing machine, which can accurately detect the turbidity of the washing liquid free from the influence of air bubbles formed by a detergent and effect optimum control of the washing and rinsing operations according to the detected values.

The above object is realized by a washing machine, which comprises a tub for receiving a laundry, detergent and water, a pulsator provided at the bottom of said tub, a detector disposed inside the tub for detecting air bubbles in the water and for producing a detection signal, drive means for supplying a drive signal to the pulsator, and control means connected to the detector and drive means for storing a reference signal which is produced from the detector when the pulsator is not operated and for controlling the drive means according to the difference between the reference signal and the detection signal during the operation of the pulsator.

This invention can be more fully understood from the following detailed description when taken in conjunction with the accompanying drawings, in which.

Figure 6:
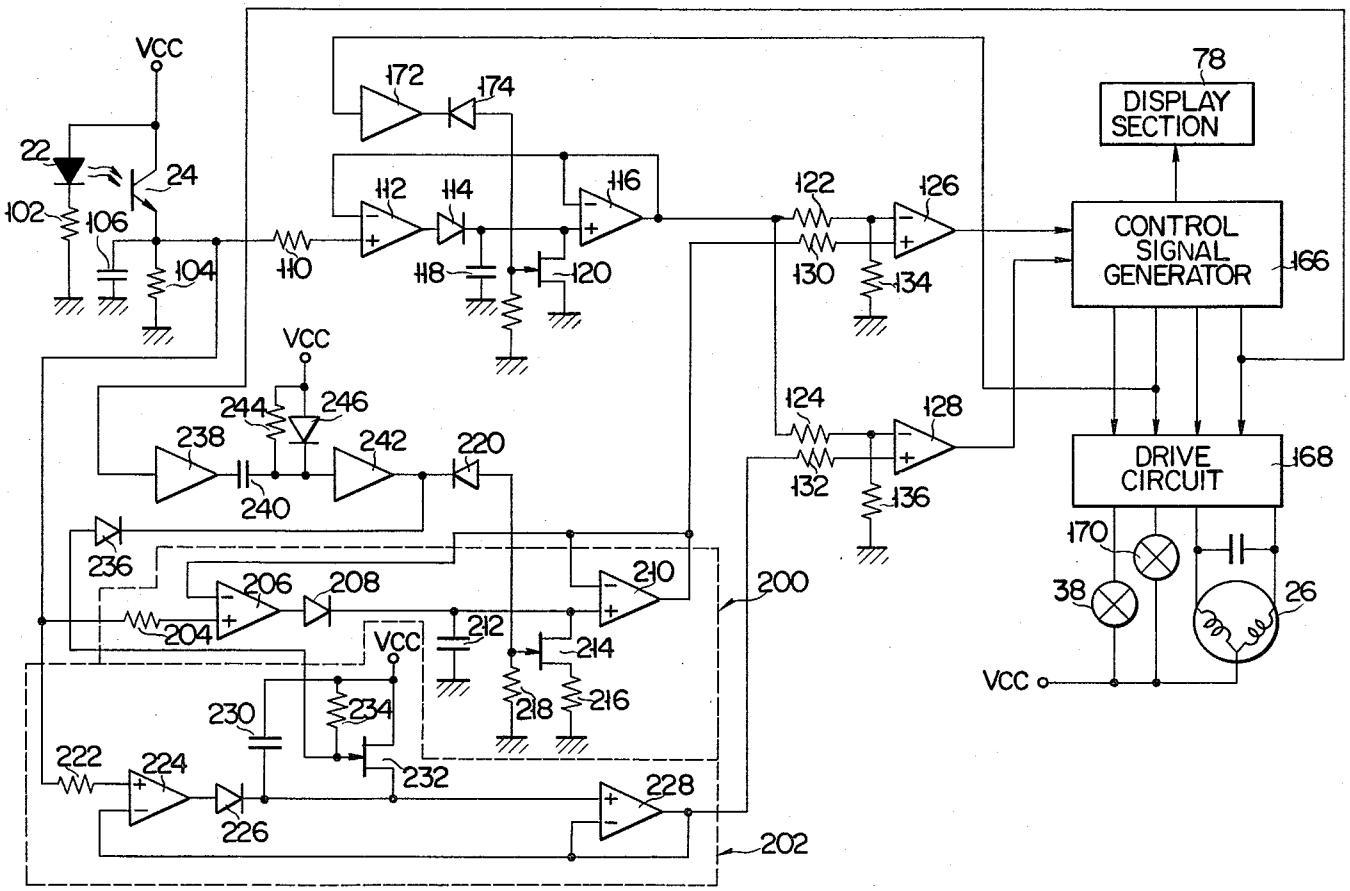

FIGS. 4A through 4G form a waveform chart showing signals in a washing operation;

FIGS. 5A through 5F form a waveform chart showing signals in a rinsing operation;

FIG. 6 is a circuit diagram, partly in block form, showing an electric circuit in a second embodiment of the invention;

FIGS. 7A through 7E form a waveform chart showing signals in a washing operation of the second embodiment; and FIGS. 8A through 8E form a waveform chart showing signals in a rinsing operation of the second embodiment.

Figure 1:
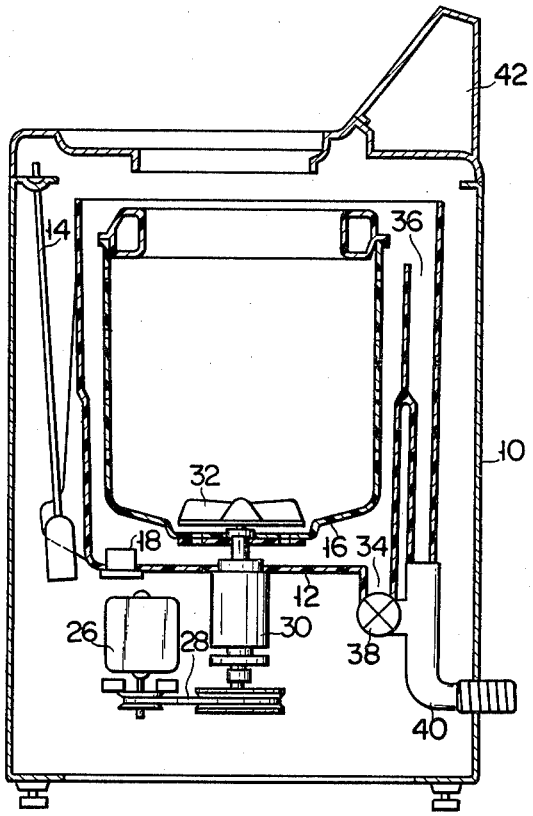
FIG. 1 is a schematic elevational sectional view showing an embodiment of the washing machine according to the invention.
Figure 2:
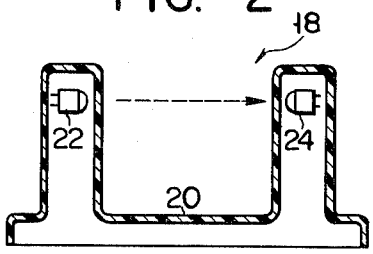
FIG. 2 is an enlarged-scale sectional view showing a detector used in the same embodiment.

Now, an embodiment of the washing machine according to the invention will be described with reference to the accompanying drawings. A water receiving tub 12 is suspended by an elastic member 14 in an outer box 10. Inside the water receiving tub 12, a rotating tub 16 having a perforated wall is disposed, and a detector 18 is provided on the bottom of the water receiving tub 12. FIG. 2 shows the detector 18. As is shown, it includes a housing 20 made of a transparent material, for instance a plastic material, and having a pair of projections opposing each other, a light-emitting element 22 disposed inside one of the projections and a light-receiving element 24 disposed inside the other projection. Referring back to FIG. 1, in lower portions of the interior of the outer box 10 a motor 26, a belt power transmission mechanism 28 and a drive unit 30 are provided. The drive unit 30 has two coaxial rotating shafts, one connected to the rotating tub 16 and the other connected to a pulsator 32. The water receiving tub 12 has a drain port 34 and an overflow port 36. The drain port 34 is communicated with an exhaust hose 40 through an electromagnetic valve 38, and the overflow port 36 is directly communicated with the exhaust hose 40. An electric circuit for processing the output signal from the detector 18 is provided within a casing 42 which is provided on top of the outer box 10.

Figure 3:
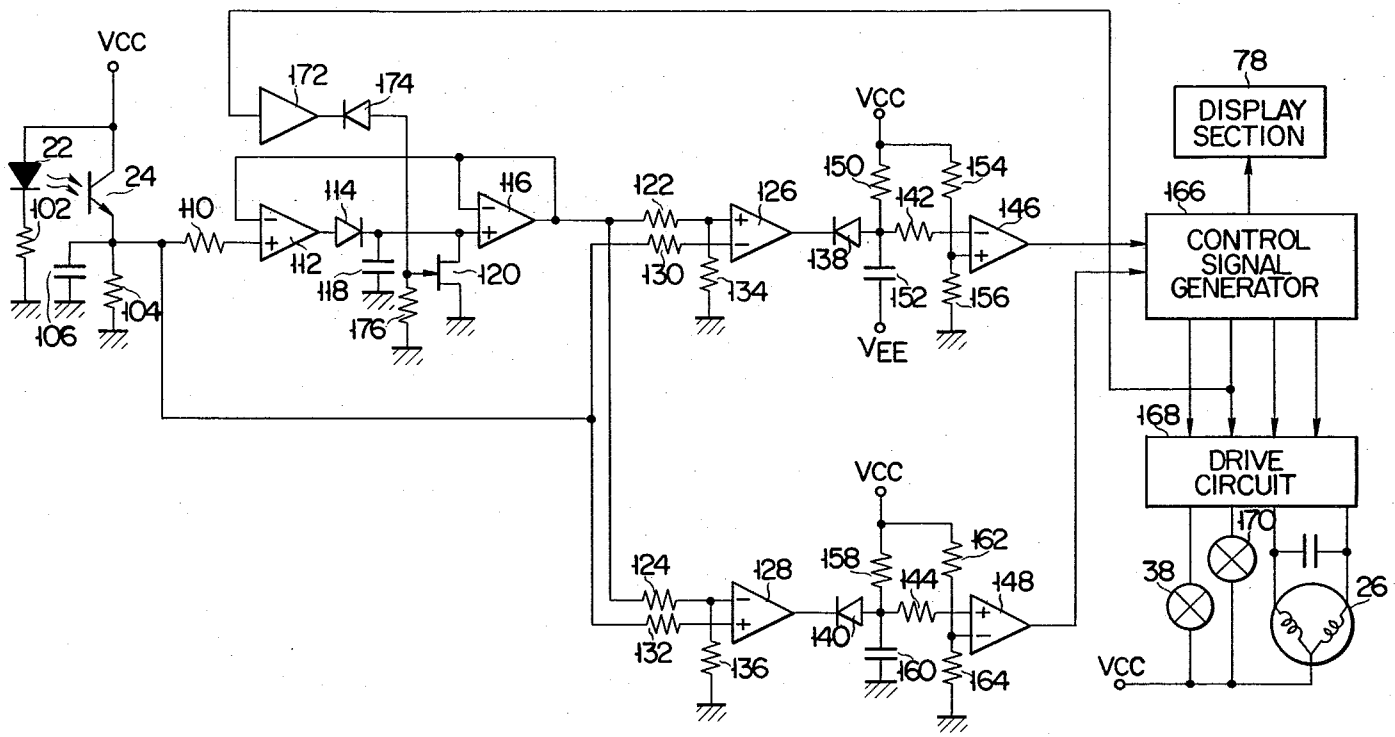
FIG. 3 is a circuit diagram, partly in block form, showing an electric circuit used in the same embodiment.

FIG. 3 shows the electric circuit for this embodiment. A positive power supply terminal $V_{CC}$ is connected to the anode of the light-emitting diode 22 and also to the collector of an NPN tube photo-transistor 24. The cathode of the light-emitting diode 22 is grounded through a resistor 102. The emitter of the photo-transistor 24 is grounded through a resistor 104 and a capacitor 106 in parallel with each other.

The emitter of the photo-transistor 24 is also connected through a resistor 110 to the non-inverting input terminal of an operational amplifier 112, which has its output terminal connected to the anode of a diode 114. The cathode of the diode 114 is connected to the non-inverting input terminal of an operational amplifier 116 and also grounded through a capacitor 118. The operational amplifier 116 has its output terminal connected to the inverting input terminals of the operational amplifiers 112 and 116, and its non-inverting input terminal is grounded through the source-drain path of an N-channel MOS FET 120. The output terminal of the operational amplifier 116 is also connected through a resistor 122 to the non-inverting input terminal of an operational amplifier 126 and through a resistor 124 to the inverting input terminal of an operational amplifier 128. The emitter of the photo-transistor 24 is connected through a resistor 130 to the inverting input terminal of the operational amplifier 126 and also through a resistor 132 to the non-inverting input terminal of the operational amplifier 128. The non-inverting input terminal of the operational amplifier 126 is grounded through a resistor 134, and the inverting input terminal of the operational amplifier 128 is grounded through a resistor 136. The operational amplifiers 126 and 128 have their output terminals connected to cathodes of respective diodes 138 and 140. The anode of the diode 138 is connected through a resistor 142 to the inverting input terminal of an operational amplifier 146, and the anode of the diode 140 is connected through a resistor 144 to the non-inverting input terminal of an operational amplifier 148. The anode of the diode 138 is also connected through a resistor 150 to the power supply terminal $V_{CC}$ and also through a capacitor 152 to a negative power supply terminal $V_{EE}$. The operational amplifier 146 has its non-inverting input terminal connected through a resistor 154 to the power supply terminal $V_{CC}$ and also grounded through a resistor 156. The anode of the diode 140 is connected through a resistor 158 to the power supply terminal $V_{CC}$ and also grounded through a capacitor 160. The operational amplifier 148 has its inverting input terminal connected through a resistor 162 to the power supply terminal $V_{CC}$ and also grounded through a resistor 164. The operational amplifiers 146 and 148 have their output terminals connected to a control signal generator 166.

The control signal generator 166 produces first and second output signals which are coupled through a drive circuit 168 to opposite terminals of the motor 26. The control signal generator 166 also produces third and fourth output signals which are coupled through the drive circuit 168 to a water supply valve 170 and the drain valve 38 respectively. The power supply terminal $V_{CC}$ is connected to the motor 26, water supply valve 170 and drain valve 38. The third output signal of the control signal generator 166 is also coupled through a buffer amplifier 172 to the cathode of a diode 174, which has its anode connected to the gate of the MOS FET 120 and also grounded through a resistor 176. The control signal generator 166 further produces a fifth output signal which is coupled to a display section 78.

Figures 4A, 4B, 4C, 4D, 4E, 4F, 4G:
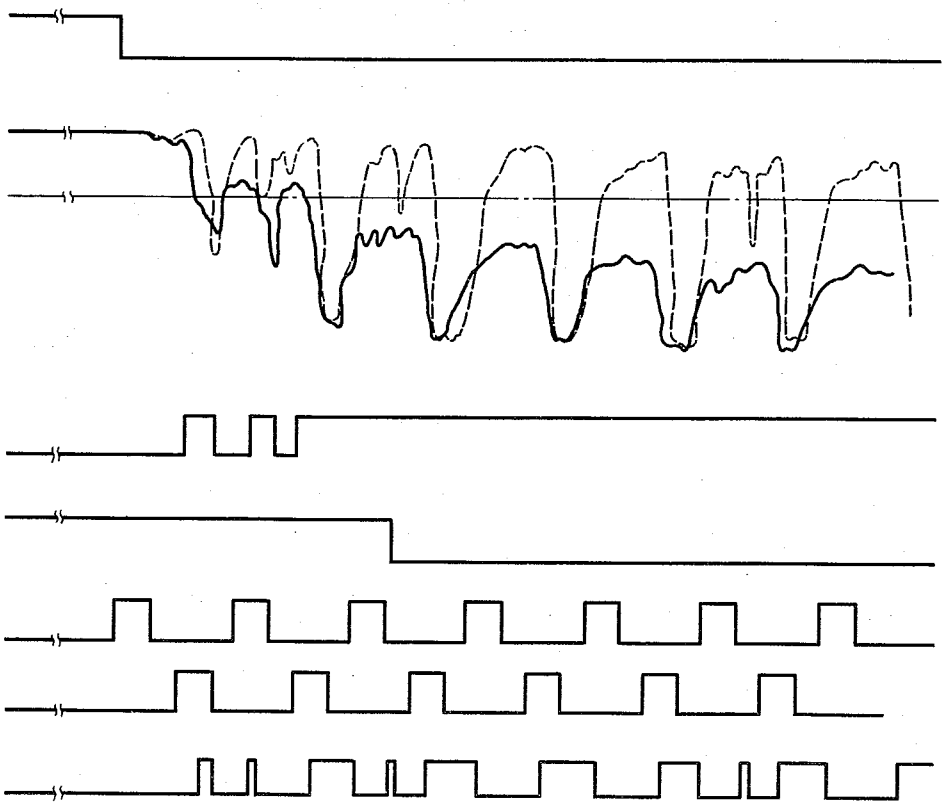

Now, the operation of this embodiment will be described by having reference also to FIGS. 4A through 4G. When a start button (not shown) is depressed after putting a laundry together with a detergent into the rotating tub 16, a high (H) level water supply signal as shown in FIG. 4A is produced from the third output terminal of the control signal generator 166. With this water supply signal the water supply valve 170 is opened to supply water into the rotating tub 16 and a water receiving tub 12. Also, with the water supply signal the output of the buffer amplifier 172 is inverted to an H level to render the gate potential of the MOS FET 120 into ground potential, that is, render the MOS FET 120 into an active state with a low impedance between its source and drain. As a result, the capacitor 118 is discharged, so that the emitter voltage signal of the photo-transistor 24, the terminal voltage signal across the capacitor 118 and the output signal of the operational amplifier 116 become equal. The output signal of the operational amplifier 116 is coupled through a voltage divider consisting of the resistors 122 and 134 to the non-inverting input terminal of the operational amplifier 126, while the emitter output signal of the photo-transistor 24 is coupled through the resistor 130 to the inverting input terminal of the operational amplifier 126. The voltage division ratio of the voltage divider consisting of the resistors 122 and 134 is set to 75%, and the input signals coupled to the inverting and non-inverting input terminals of the operational amplifier 126 are respectively as shown by solid line and dot and bar line in FIG. 4B. At this time, the output signal of the operational amplifier 126 is at a low (L) level as shown in FIG. 4C. Thus, there is current flowing from the power supply terminal $V_{CC}$ through the resistor 150 and diode 138, and the output signal from the operational amplifier 146 is at an H level as shown in FIG. 4D.

When a predetermined water level in the water receiving tub 12 is reached, the water supply signal is inverted to an L level as shown in FIG. 4A, thus closing the water supply valve 170 to discontinue water supply. Also, with the change of the water supply signal to an L level, the gate potential of the MOS FET 120 becomes negative to provide a high impedance between the source and drain. Thus, the discharging circuit for the capacitor 118 is no longer formed, and the terminal voltage across the capacitor 118 is held at the value of the emitter voltage of the photo-transistor 24 immediately before the inversion of the water supply signal to the L level. At this time, the photo-transistor 24 is receiving light from the light-emitting diode 22 through fresh water supplied to the water receiving tub 12, and the emitter voltage of the photo-transistor 24 is thus high. In this way, the capacitor 118 memorizes the transparency of water, i.e., the turbidity of water, at the time of the end of water supply, i.e., at the time of the start of washing. The signal coupled to the non-inverting input terminal of the operational amplifier 126 is held at 75% of the value at this time as shown by the dot and bar line in FIG. 4B.

When the water supply is stopped, forward and reverse motor drive signals alternately inverted to an H level, as shown in FIGS. 4E and 4F respectively, are produced from the respective first and second output terminals of the control signal generator 166. The forward and reverse motor drive signals, which are pulse signals, have a period $T_c$, and there is a slight pause period between the instants of appearance of consecutive forward and reverse motor drive pulses. Thus, the forward and reverse drive terminals of the motor 26 are alternately energized to cause alternate forward and reverse rotations of the pulsator 32, thus producing a water stream flowing in alternately opposite directions. In this way, a washing operation is brought about and proceeds.

As the pulsator 32 is rotated, the detergent is dissolved in water and stains are removed from the laundry. Consequently, the transparency of the washing liquid is gradually reduced to reduce the emitter voltage of the photo-transistor 24 as shown in FIG. 4B. More particularly, when the laundry is very dirty, the emitter voltage changes in a manner as shown by solid curve in FIG. 4B, while in case when the laundry is not so dirty it changes in a manner as shown by dashed curve. In this operation, the washing liquid contains air bubbles formed by the detergent in addition to the stain component removed from the laundry. When air bubbles are found in the light path between the light-emitting diode 22 and photo-transistor 24 of the detector 18, the emitter voltage thereof is extremely low. During the rotation of the pulsator 32 the air bubbles are brought down to the bottom of the water receiving tub 12, while during the pause period of the pulsator 32 they are floated up to the surface of the washing liquid. Thus, the emitter voltage of the photo-transistor 24 alternately takes minimum and maximum levels corresponding to the alternate rotation and pause periods of the pulsator 32. More particularly, the emitter voltage of the photo-transistor 24 is at a minimum level when much air bubbles are found in the light path of the detector 18 while it has a maximum value when practically no air bubbles are present in the light path. This means that the maximum value of the emitter voltage of the photo-transistor 24 represents the actual turbidity of the washing liquid. With a very dirty laundry, the maximums of the emitter voltage progressively become lower with the lapse of time as shown by the solid curve in FIG. 4B as the stains are removed from the washing and dissolved in the washing liquid. With a laundry which is not so dirty, the maximums are held at comparatively high values as shown by the dashed curve in FIG. 4B, above 75% of the terminal voltage across the capacitor 118, because the stains dissolved in the washing liquid are not increased so much with the lapse of time. Thus, with a very dirty laundry the output signal of the operational amplifier 126 is repeatedly inverted to the H and L levels for a couple of rotation periods of the pulsator 32 and thereafter held at the H level as shown in FIG. 4C, while with a lightly dirty laundry its inversion to the H and L levels is continuously repeated as shown in FIG. 4G.

With the inversion of the output signal of the operational amplifier 126 to the H level, the charging of the capacitor 152 is started. If the output signal of the operational amplifier 126 is not inverted to the L level for a subsequent constant period of time $T_a$, the output signal of the operational amplifier 146 is inverted to the L level due to the charging of the capacitor 152. This constant period $T_a$ is set to be slightly shorter than the period $T_c$ of the forward and reverse motor drive pulse signals. Thus, in case of a very dirty washing the output signal of the operational amplifier 146 is inverted to the L level after the lapse of the period $T_a$ from the instant, from which the output signal of the operational amplifier 126 is held at the H level as shown in FIG. 4D. In case of a lightly dirty washing, the output signal of the operational amplifier 146 is held at the H level throughout the washing operation. It will thus be understood that after the lapse of a predetermined period of time from the instant when the water supply is cut off, the output signal of the operational amplifier 146 is either at the H or L level depending upon the dirtiness of the laundry.

The control signal generator 166 controls the washing operation according to the level of the output signal of the operational amplifier 146 from the aforementioned instant when the predetermined period of time has been elapsed from the water supply cut-off. For example, in case of a very dirty washing it intensifies the water stream by extending the drive period of the motor 26 or increasing the motor drive force. It will be appreciated that since the washing operation is controlled according to whether the maximum value of the emitter output of the photo-transistor 24 are higher than a reference level, accurate control free from the influence of air bubbles is possible.

When the washing operation is ended, the motor 26 is stopped, and a drain signal is produced from the fourth output terminal of the control signal generator 166 to open the drain valve 38. When water is drained from the water receiving tub 12, the motor 26 is rotated only in one direction for somewhile. This is a dehydrating operation period.

Figure 5A:
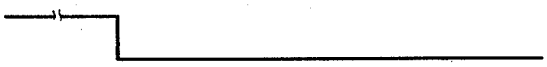
Figure 5B:
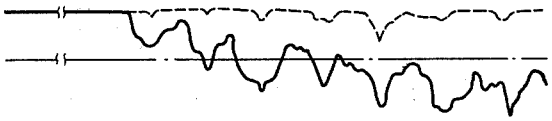
Figure 5C:
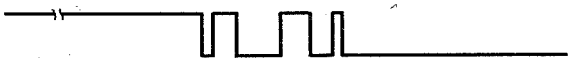

After the dehydrating operation is ended, a rinsing operation with fresh water is brought about. For this operation, like the washing operation, the control signal generator 166 produces an H level water supply signal as shown in FIG. 5A, which is inverted to an L level when a predetermined quantity of water is collected in the water receiving tub 12. As in the washing operation, the capacitor 118 memorizes the transparency of rinsing water at the instant of the end of water supply, i.e., at the instant of the start of the rinsing operation. The voltage division ratio of the voltage divider constituted by the resistors 124 and 136 is also set to 75%, and signals respectively as shown by solid line and dot and bar line in FIG. 5B are coupled to the respective non-inverting and inverting input terminals of the operational amplifier 128. Thus, an H level output signal as shown in FIG. 5C is produced from the operational amplifier 128. Also, an H level output signal is produced from the operational amplifier 148 due to the charging of the capacitor 160.

Figure 5D:
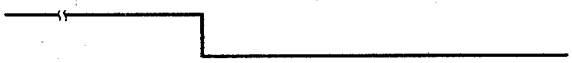
Figure 5E:
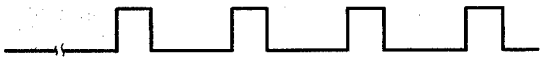
Figure 5F:
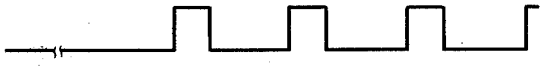

After the water supply is ended, forward and reverse motor drive pulse signals as shown in FIGS. 5E and 5F respectively are produced, thus producing a water stream flowing in alternately opposite directions as in the washing operation. The forward and reverse motor drive pulse signals at this time have the same pulse period as the signals shown in FIGS. 4E and 4F.

The rinsing operation is ended when the conditions that the concentration of the detergent in the washing liquid is sufficiently low and that the turbidity of the water is also sufficiently low are satisfied. The concentration of the detergent can be determined from the quantity of air bubbles in the water, and the turbidity can be determined from the transparency of the water. While the turbidity of the water is substantially uniform over the entire water within the water receiving tub 12 once the operation of the pulsator 32 is started, the air bubbles are lowered during the rotation period of the pulsator 32 and float up during the pause period thereof as in the washing operation. Thus, for checking whether the rinsing is sufficient, it is necessary to detect the emitter voltage of the photo-transistor 24 when much air bubbles are found in the light path of the detector 20, i.e., the minimum value of the emitter voltage.

In case of a high detergent concentration in the water and considerable turbidity thereof, the emitter voltage of the photo-transistor 24 is reduced with the progress of the rinsing operation in a manner as shown by the solid curve in FIG. 5B. Consequently, the output signal of the operational amplifier 128 is repeatedly inverted to H and L levels and is eventually set to the L level as shown in FIG. 5C. When the output signal of the operational amplifier 128 is set to the L level, the output signal of the operational amplifier 148 is set to the L level and held thereat for a predetermined period of time $T_b$ as shown in FIG. 5D. After the predetermined period $T_b$, the output signal of the operational amplifier 148 will not be at the L level unless the output signal of the operational amplifier 128 is inverted to the H level. The constant period $T_b$ is set to correspond to several cycle periods of the pulsator 32, so that when the rinsing is insufficient, i.e., when much stains still remain without being removed, the output signal of the operational amplifier 148 will not be returned to the H level once it is changed to the L level as shown in FIG. 5D. In case of a rinsing which does not contain much residual detergent, the emitter voltage of the photo-transistor 24 is not reduced so much as shown by the dot and bar curve in FIG. 5B, so that the output signals of the operational amplifiers 128 and 148 are held at the H level. It is to be understood that after the lapse of a predetermined period of time from the end of the water supply the level of the output signal of the operational amplifier 148 is set according to the extent of the rinsing.

As in the washing operation, the control signal generator 166 controls the rinsing operation according to the level of the output signal of the operational amplifier 148 from the instant after the lapse of a predetermined period of time from the end of the water supply. More particularly, when the output signal of the operational amplifier 148 is at the L level, it decides that the rinsing is insufficient and extends the period of the rinsing operation or intensifies the water stream for the rinsing.

It will be appreciated that the rinsing operation is controlled according to whether the minimum value of the emitter voltage of the photo-transistor 24 is lower than a reference value, so that it is possible to obtain the value of the emitter voltage when air bubbles are found in the light path of the detector 20.

Also, the reference values for comparison in the washing and rinsing operations are based upon the doses of received light at the time of the start of the washing and rinsing operations, so that there is no need of making any compensation of the output of the detector 18 for temperature or for changes of any parameter in long use. Further, it is not necessary to make accurate adjustment of the light-emitting and light-receiving elements for fluctuations of the characteristics. Furthermore, while in the above embodiment separate detecting circuits are provided respectively for the washing and rinsing operations, the circuit construction can be simplified. It is possible to provide a single detecting circuit for both the operations. Moreover, the control signal generator 166 can supply signals representing data of the individual operations to the display section 78 for display thereon.

FIG. 6 shows a circuit diagram of a second embodiment of the invention. In the Figure, like parts as those in the preceding first embodiment are designated by like reference numerals, and their description is omitted. The emitter of photo-transistor 24 is connected to input terminals of a maximum level detection circuit 200 and a minimum level detection circuit 202 while it is also connected through resistor 110 to the non-inverting input terminal of an operational amplifier 112. The input terminal of the maximum level detection circuit 200 is connected to the non-inverting input terminal of an operational amplifier 206 through a resistor 204. The output terminal of the operational amplifier 206 is connected to the non-inverting input terminal of an operational amplifier 210 through a diode 208 in a forward direction. The non-inverting input terminal of the operational amplifier 210 is grounded through a capacitor 212 and also through an N-channel MOS FET 214 and a resistor 216 in series. The gate of the MOS FET 214 is grounded through a resistor 218 and connected to the anode of a diode 220. The output terminal of the operational amplifier 210 is connected to the inverting input terminals of the operational amplifiers 210 and 206 and to the non-inverting input terminal of an operational amplifier 126 through a resistor 130. That is, the output terminal of the operational amplifier 210 is the output terminal of the maximum level detection circuit 200. The output terminal of the operational amplifier 116 is connected to the inverting input terminal of the operational amplifier 126 through a resistor 122.

The input terminal of the minimum level detection circuit 202 is connected to the non-inverting input terminal of an operational amplifier 224 through a resistor 222.

The output terminal of the operational amplifier 224 is connected to the non-inverting input terminal of an operational amplifier 228 through a diode 226 in a forward direction. The non-inverting input terminal of the operational amplifier 228 is connected to a power supply terminal $V_{CC}$ through a capacitor 230 and also through an N-channel MOS FET 232. The gate of the MOS FET 232 is connected to the power supply terminal $V_{CC}$ through a resistor 234 and also to an anode of a diode 236. The output terminal of the operational amplifier 228 is connected to the inverting input terminals of the operational amplifiers 224 and 228 and to the non-inverting input terminal of an operational amplifier 128 through a resistor 132. That is, the output terminal of the operational amplifier 228 is the output terminal of the minimum level detection circuit 202.

The first output signal of the control signal generator 166, i.e., the forward motor drive signal is supplied to one end of a capacitor 240 through a buffer amplifier 238. The other end of the capacitor 240 is connected to cathodes of diodes 220 and 236 through a buffer amplifier 242. The power supply terminal $V_{CC}$ is connected to an input terminal of the buffer amplifier 242 through a resistor 244 and diode 246 in parallel.

Figure 7A:
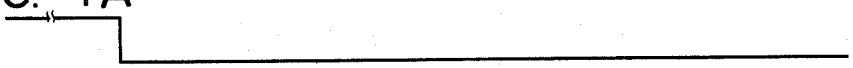
Figure 7B:
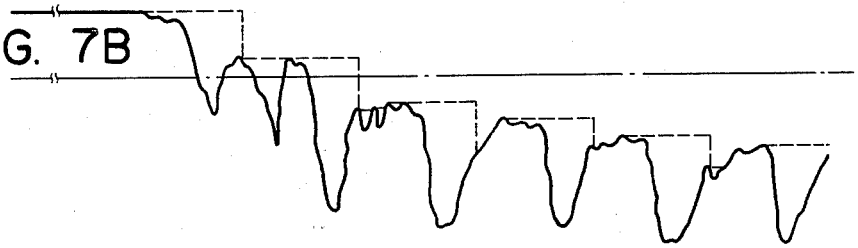
Figure 7C:
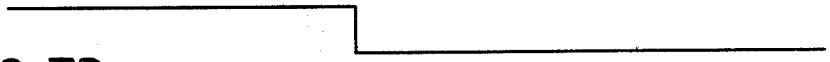

The operation of this embodiment will now be described. Like the first embodiment, for the washing operation, water is supplied to the water receiving tub 12 according to an H level water supply signal as shown in FIG. 7A. Also, with the water supply signal MOS FET 120 is rendered into an active state, and the output signals of the operational amplifier 116 and the maximum level detection circuit 200 become equal. Thus, signals respectively as shown by a solid line and a dot and bar line are coupled to the respective non-inverting and inverting input terminals of the operational amplifier 126, and the output signal thereof is at the H level as shown in FIG. 7C.

Figure 7D:
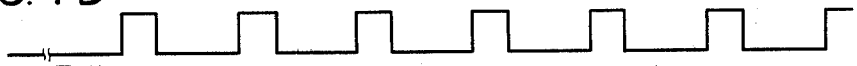
Figure 7E:
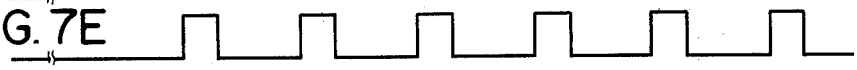

When the water supply is ended, the water supply signal is inverted to the L level as shown in FIG. 7A, and the terminal voltage across the capacitor 118 is held at the level of the emitter voltage of the photo-transistor 24 at the time of the end of the water supply. Like the first embodiment, when the water supply is ended, forward and reverse motor drive pulse signals respectively as shown in FIGS. 7D and 7E are produced from the respective first and second output terminals of the control signal generator 166. As the washing operation proceeds with the rotation of the pulsator 32, stains are progressively removed from the laundry and dissolved in the washing liquid, so that the emitter voltage of the photo-transistor 24 is reduced in a manner as shown by the solid curve in FIG. 7B. On the other hand, the potential on the non-inverting input terminal of the operational amplifier 126, i.e., the output of the maximum level detection circuit 200, is changed in a manner as shown by the dot and bar curve as shown in FIG. 7B. The maximum level detection circuit 200 is reset by the pulses of the forward motor drive signal, so that its output signal is changed stepwise. In other words, the output signal of the maximum level detection circuit 200 corresponds to the emitter output of the photo-transistor 24 at the time of the pause period of the pulsator 32. The maximum level detection circuit 200 may be reset by the reverse motor drive signal as well. When the output signal of the maximum level detection circuit 200 becomes lower than the output signal of the operational amplifier 116 as shown in FIG. 7B, the output signal of the operational amplifier 126 is inverted to the L level as shown in FIG. 7C. The control signal generator 166 controls the washing operation by determining the output level of the operational amplifier 126 after a predetermined period of time from the start of the washing operation.

Figure 8A:
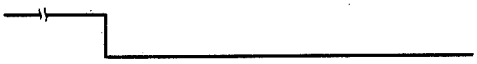
Figure 8B:
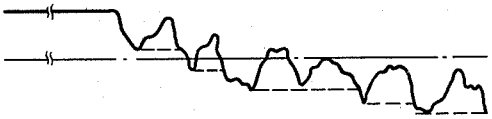
Figure 8C:
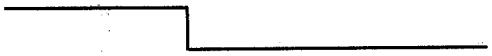
Figure 8D:
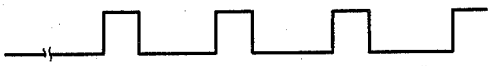
Figure 8E:
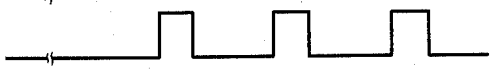

For the rinsing operation with fresh water, a water supply signal as shown in FIG. 8A is produced again. Signals as respectively shown by a solid line and a dot and bar line in FIG. 8B are coupled to the respective non-inverting and inverting input terminals of the operational amplifier 128, and the output signal thereof is at the H level as shown in FIG. 8C. When the water supply is ended, forward and reverse motor drive signals as respectively shown in FIGS. 8D and 8E are coupled to the pulsator 32 for rotating it in alternately opposite directions. As the rinsing proceeds in this way, the emitter output of the photo-transistor 24 is changed in a manner as shown by the solid curve in FIG. 8B, and the output signal of the minimum level detection circuit 202 is changed stepwise as shown by the dot and bar curve in FIG. 8B. The minimum level detection circuit 202 is also reset by the forward motor drive signal, and the photo-transistor 24 thus detects the transparency of the rinsing water during the rotation periods of the pulsator 32. As has been shown, with this embodiment accurate detection of the extents of washing and rinsing can also be obtained.

While in the above embodiments only a single reference level is used for determining the extent of washing and rinsing, it is also possible to use a plurality of decision reference levels and carry out a fine control of the washing and rinsing extents with respect to the individual decision levels. Further, the detection of the extent of the washing may be made when air bubbles are caused to float up by temporarily stopping the pulsator during the washing operation. Still further, while the washing and rinsing extents are detected according to the output levels of the operational amplifiers 126 and 128 predetermined periods of time after the start of the washing and rinsing operations, it is also possible to detect the washing and rinsing extents according to the instants of the level inversion of these outputs. Furthermore, the detector may be disposed in an upper portion of the water receiving tub interior. In this case, the detection is made in converse timings to the case of the above embodiments, that is, the detection signals are read out during the rotation periods of the pulsator in the washing operation and during the pause periods of the pulsator in the rinsing operation.

What is claimed is:

1. A washing machine comprising:

a tub for receiving a laundry, detergent and water;

a pulsator provided at the bottom of said tub;

a detector disposed inside said tub for detecting air bubbles in the water and for producing a detection signal;

drive means for supplying a drive signal to said pulsator; and control means connected to said detector and drive means for storing a reference signal which is produced from said detector when said pulsator is not operated and for controlling said drive means according to the difference between said reference signal and the detection signal during the operation of said pulsator.

2. A washing machine comprising:

a tub for receiving laundry, detergent and water;

a pulsator provided at the bottom of said tub;

a detector disposed inside said tub for detecting the turbidity of liquid therein and for producing a detecting signal;

drive means for supplying a drive signal to said pulsator; and control means connected to said detector and drive means for controlling said drive means according to the detection signal when a first amount of air bubbles is found near said detector in the case of a washing in response to the operation of said pulsator and according to the detection signal when a second amount of air bubbles greater than said first amount is found near said detector in the case of rinsing in response to the operation of said pulsator.

3. A washing machine according to claim 2, wherein said detector is disposed at the bottom of said tub and includes a light-emitting section and light-receiving section, these sections projecting into the interior of said tub.

4. A washing machine according to claim 3, wherein said control means includes a circuit for detecting the maximum and minimum levels of the output signal from said light receiving section, a reference signal generating circuit and a comparator for comparing the output signals from said detecting circuit and said reference signal generating circuit.

5. A washing machine according to claim 4, wherein said control means compares the maximum level of the output signal from said light-receiving section with a reference signal a predetermined period of time after the start of the washing operation and compares the minimum level of the output signal from said light-receiving section with a reference signal a predetermined period of time after the start of the rinsing operation, and also wherein said drive means controls the period and strength of driving of said pulsator according to the output signal of said comparator.

6. A washing machine according to claim 5, wherein said reference signal generating circuit includes capacitors for holding the output signal from said light receiving section at the time of the start of the washing and rinsing operations respectively, the signals held by said capacitors being used as said reference signals.

* * * * *